US008787611B2

(12) United States Patent
Sasaki et al.

(10) Patent No.: US 8,787,611 B2
(45) Date of Patent: Jul. 22, 2014

(54) FRAME FOR SPEAKER, SPEAKER USING SAME, AND ELECTRONIC APPARATUS AND MOBILE DEVICE USING SPEAKER

(75) Inventors: Matsuhiro Sasaki, Mie (JP); Yasuyuki Hiragaki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/979,138

(22) PCT Filed: Jan. 31, 2012

(86) PCT No.: PCT/JP2012/000590

§ 371 (c)(1),
(2), (4) Date: Jul. 11, 2013

(87) PCT Pub. No.: WO2012/117663

PCT Pub. Date: Sep. 7, 2012

(65) Prior Publication Data

US 2013/0287246 A1 Oct. 31, 2013

(30) Foreign Application Priority Data

Mar. 1, 2011 (JP) ..... 2011-043478

(51) Int. Cl.

| | |
|---|---|
| ***H04R 1/00*** | (2006.01) |
| ***H04R 9/02*** | (2006.01) |
| ***H04R 1/06*** | (2006.01) |
| *H04R 9/06* | (2006.01) |

(52) U.S. Cl.

CPC ..... *H04R 1/00* (2013.01); *H04R 2400/11* (2013.01); *H04R 9/02* (2013.01); *H04R 9/06* (2013.01); *H04R 1/06* (2013.01)

USPC ..... 381/412; 381/433

(58) Field of Classification Search

CPC ..... H04R 1/00

See application file for complete search history.

(56) References Cited

U.S. PATENT DOCUMENTS 5,757,945 A * 5/1998 Sakamoto ..... 381/400
5,892,185 A * 4/1999 Takahashi et al. ..... 181/171

(Continued)

FOREIGN PATENT DOCUMENTS

JP 62-098174 U 6/1987
JP 04-209476 7/1992

(Continued)

OTHER PUBLICATIONS

International Search Report of PCT Application No. PCT/JP2012/000590 dated Mar. 19, 2012.

*Primary Examiner* — Brian Ensey
*Assistant Examiner* — Norman Yu
(74) *Attorney, Agent, or Firm* — Panasonic Patent Center

(57) ABSTRACT

A connector housing made of resin includes a hole through which an eyelet terminal is inserted, a first wall for regulating a position of the eyelet terminal in an inserting direction of the eyelet terminal, and a second wall for regulating the position of the eyelet terminal in a direction opposite to the inserting direction of the eyelet terminal. The eyelet terminal includes a stopper contacts a wall surface and is provided at a place corresponding to the wall surface for regulating the position of the eyelet terminal in the inserting direction of the eyelet terminal, and a protrusion engaged with the second wall. The second wall is provided on a side wall surface of the hole. The above structure prevents the eyelet terminal from being taken off from the connector housing.

11 Claims, 6 Drawing Sheets

(56) References Cited

U.S. PATENT DOCUMENTS

| | | | | |
|---|---|---|---|---|
| 7,185,734 | B2 * | 3/2007 | Widmer et al. | 181/135 |
| 7,336,798 | B2 * | 2/2008 | Ono et al. | 381/433 |
| 7,912,242 | B2 * | 3/2011 | Hikichi | 381/433 |
| 8,290,201 | B2 * | 10/2012 | Kamimura et al. | 381/423 |
| 2007/0269075 | A1 * | 11/2007 | Kato | 381/394 |
| 2008/0176454 | A1 | 7/2008 | Imai | |

FOREIGN PATENT DOCUMENTS

| | | |
|---|---|---|
| JP | 08-148243 | 6/1996 |
| JP | 2000-308191 | 11/2000 |
| JP | 2002-125292 | 4/2002 |
| JP | 2008-181729 | 8/2008 |
| JP | 2009-140839 | 6/2009 |

* cited by examiner

FRAME FOR SPEAKER, SPEAKER USING SAME, AND ELECTRONIC APPARATUS AND MOBILE DEVICE USING SPEAKER

CROSS-REFERENCE TO RELATED APPLICATIONS

The present application is a U.S. national phase application of PCT international application PCT/JP2012/000590 filed on Jan. 31, 2012, which claims priority to Japanese Patent Application No. 2011-043478 filed on Mar. 1, 2011, the contents of both of which are incorporated herein by reference.

TECHNICAL FIELD

The present invention relates to a loudspeaker frame to be used in, e.g. vehicles, a loudspeaker using the loudspeaker frame, and an electronic device, such as a mobile device, using the loudspeaker.

BACKGROUND ART

FIG. 10 is a perspective view of a conventional loudspeaker.

The loudspeaker includes frame 111 and connector 112 made of resin. Frame 111 and connector 112 are manufactured independently. Connector 112 includes connector housing 113 and two eyelet terminals 114 inserted into connector housing 113 to be and rigidly mounted to housing 113.

Eyelet terminal 114 is inserted into connector to be rigidly mounted to connector housing 113 in the method below. First, eyelet terminal 114 is formed by punching with a metal die. At this moment, undulations having a sawtooth shape are formed in eyelet terminal 114. Then, eyelet terminal 114 is press-fitted into a hole provided in connector housing 113 so as to press-fit the undulations having the sawtooth shape into the hole in connector housing 113, thereby mounting eyelet terminal 114 rigidly into connector housing 113.

Conventional loudspeaker 110 discussed above; however, has a drawback of fair reliability to temperature change.

Patent Literature 1 is known as related art to the present invention.

CITATION LIST

Patent Literature

Patent Literature 1: Japanese Patent Laid-Open Publication No. 2000-308191

SUMMARY OF THE INVENTION

The present invention provides a loudspeaker frame highly reliable to temperature change, a loudspeaker using the loudspeaker frame, and an electronic device, such as a mobile device, using the loudspeaker.

In the loudspeaker frame of the present invention, a first wall and a second wall are provided on a bottom of a connector housing made of resin. The first wall regulates a position of an eyelet terminal in an inserting direction while the second wall regulates a position of the eyelet terminal opposite to the inserting direction. The eyelet terminal includes a stopper and a first protrusion. The stopper contacts the first wall so as to regulate the position of the eyelet terminal in inserting direction, and the first protrusion is engaged with the second wall which is formed on a lateral surface of a hole.

This structure allows first and second stoppers which regulate it in the directions different from each other to couple the eyelet terminal securely with the connector housing, thereby preventing the eyelet terminal from being taken off from the connector housing. As a result, this loudspeaker frame improves the reliability to temperature change.

DETAIL DESCRIPTION OF PREFERRED EMBODIMENTS

Exemplary Embodiment 1

A loudspeaker frame in accordance with Exemplary Embodiment 1 will be described below.

Figure 1:
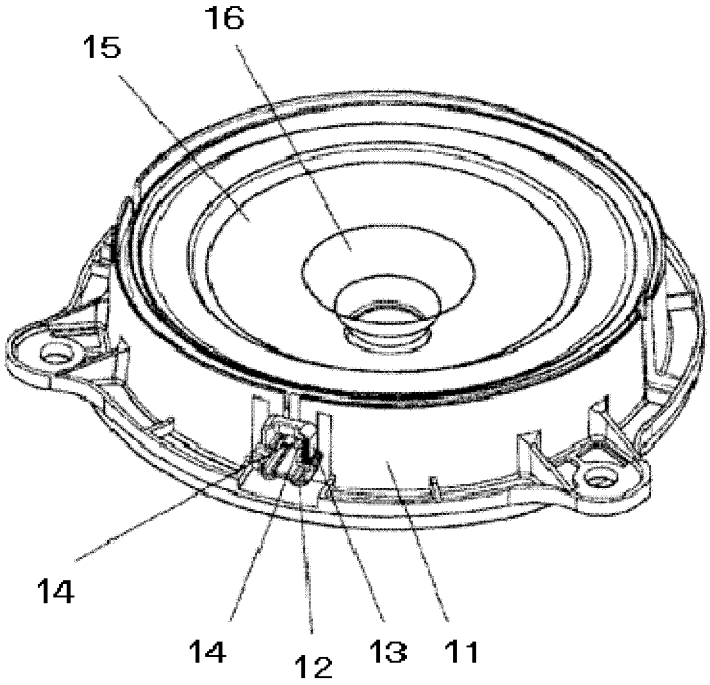
FIG. 1 is a perspective view of a loudspeaker frame in accordance with Exemplary Embodiment 1 of the present invention.
Figure 2:
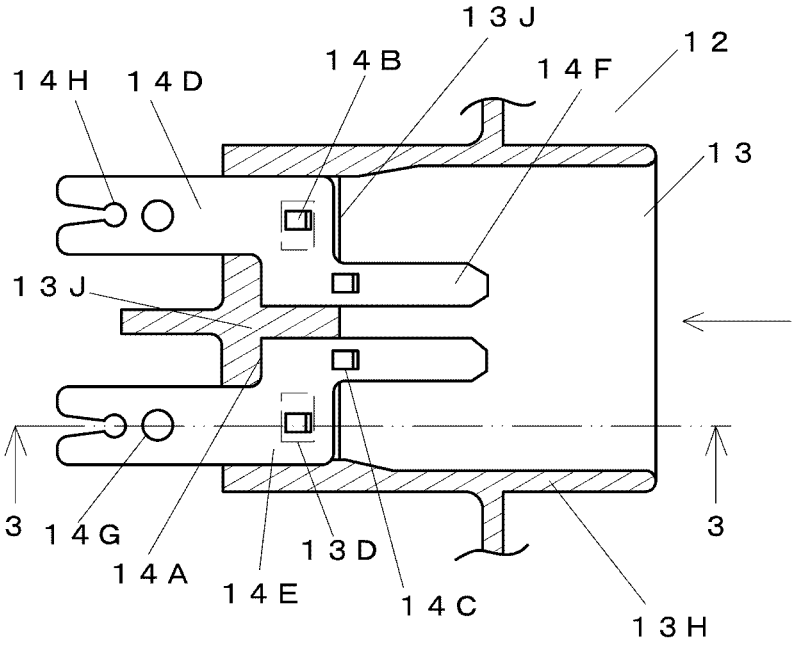
FIG. 2 is an enlarged sectional view of an essential part of a connector section of the loudspeaker frame in accordance with Embodiment 1.
Figure 3:
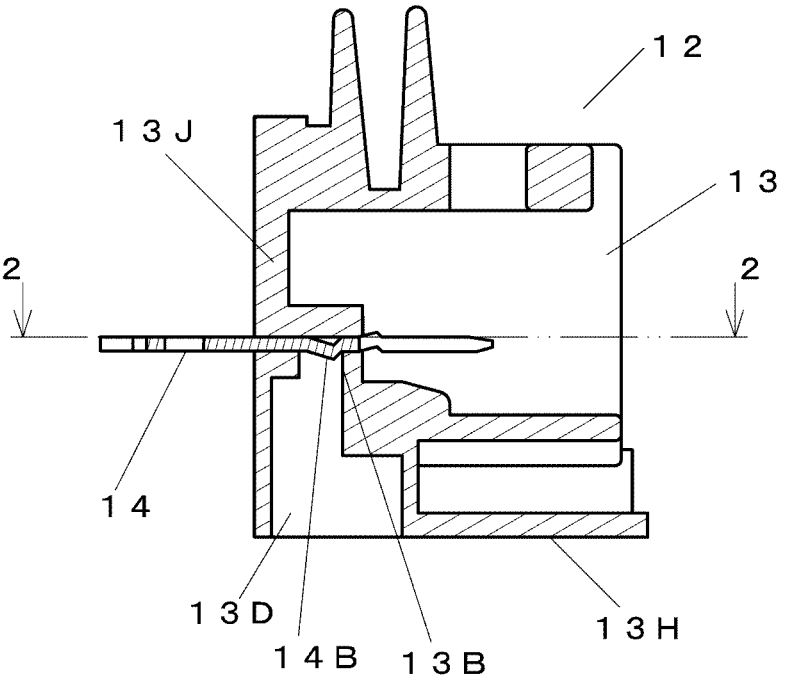
FIG. 3 is an enlarged sectional view of the connector section along line 3-3 shown in FIG. 2.

FIG. 1 is a perspective view of the loudspeaker frame in accordance with Embodiment 1 of the present invention. FIG. 2 is a sectional view of an enlarged essential part of a connector section of the loudspeaker frame in accordance with Embodiment 1. FIG. 3 is a sectional view of an enlarged essential part of the connector section cut along line 3-3 shown in FIG. 2.

Figure 4A:
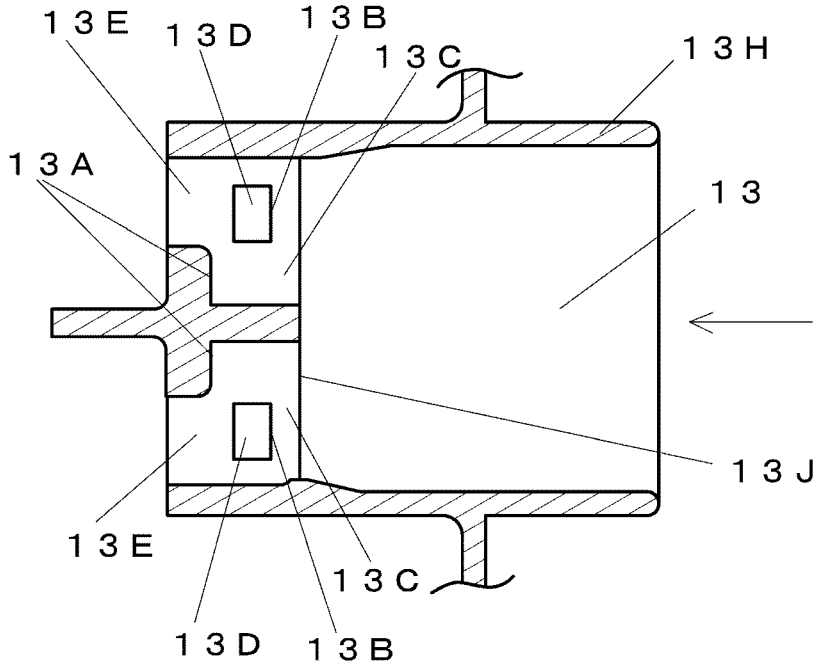
FIG. 4A is an enlarged sectional view of a connector housing of the loudspeaker frame in accordance with Embodiment 1.
Figure 4B:
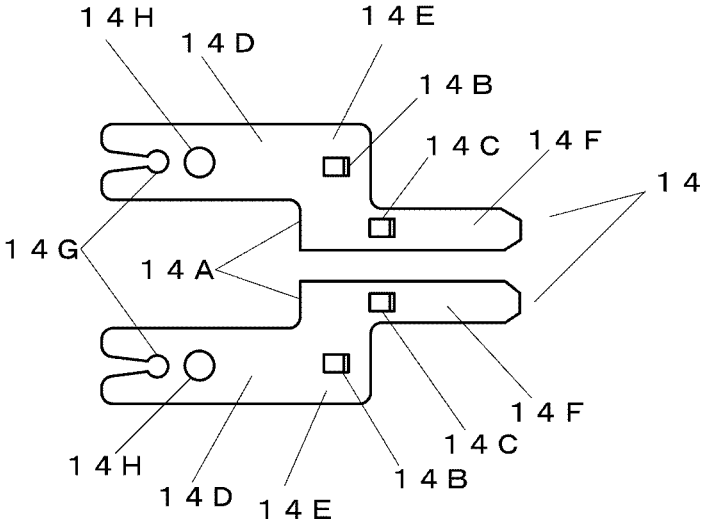
FIG. 4B is a front view of eyelet terminals of the loudspeaker frame in accordance with Embodiment 1.

FIG. 4A is a sectional view of an enlarged essential part of a connector housing of the loudspeaker frame in accordance with Embodiment 1. FIG. 4B is a front view of an eyelet terminal of the loudspeaker frame in accordance with Embodiment 1. In the following description, a plane direction refers to a direction viewed from a front (on a diaphragm side) of an assembled loudspeaker. In FIGS. 2 and 4, a lateral direction is an X-direction, and a vertical direction is a Y-direction. In FIG. 3, a vertical direction is a Z-direction, and a lateral direction is the X-direction. FIG. 2 is a sectional view of an enlarged essential part of the connector section along line 2-2 shown in FIG. 3.

As shown in FIGS. 2, 3, 4A and 4B, connector 12 includes connector housing 13 made of resin and eyelet terminals 14 which have flat plate shapes and which is disposed in connector housing 13. Connector 12 is coupled with frame 11 made of resin. First wall 13A and second wall 13B are provided on bottom 13J of connector housing 13. First wall 13A regulates a position of eyelet terminal 14 in an inserting direction thereof (denoted by an arrow shown in FIG. 2) while second wall 13B regulates a position of the eyelet terminal in a direction reverse to the inserting direction.

Eyelet terminal 14 includes stopper 14A and first protrusion (lanced and bent) 14B. Stopper 14A is disposed at a place corresponding to first wall 13A, and configured to contact wall 13A. This structure regulates the position of eyelet terminal 14 in the inserting direction thereof. First protrusion 14B is configured to be engaged with second wall 13B. Holes 13C through which eyelet terminals 14 extend are provided in bottom 13J. Second wall 13B is formed in a side surface of hole 13C.

This structure regulates the position of eyelet terminal 14 in the inserting direction when stopper 14A contacts first wall 13A. On top of that, first protrusion 14B is engaged with second wall 13B, thereby regulating the position of eyelet terminal 14 in the direction reverse to the inserting direction. Eyelet terminal 14 can be prevented from being taken off from connector housing 13, thus coupling eyelet terminal 14 securely with connector housing 13. As a result, the loudspeaker frame becomes more reliable to changes in temperature. Stopper 14A and first protrusion 14B position eyelet terminals 14 accurately with respect to connector housing 13.

Figure 10:
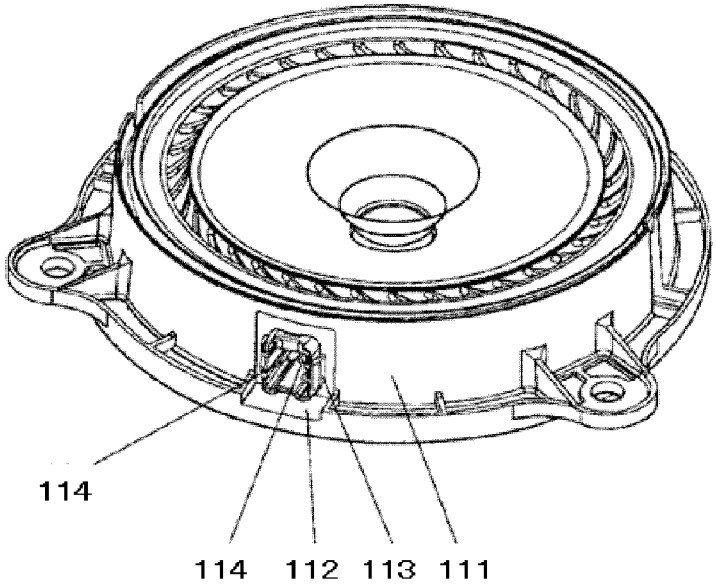
Fig.10 PRIOR ART
FIG. 10 is a perspective view of a conventional loudspeaker.

The conventional loudspeaker shown in FIG. 10, on the other hand, has a problem of poor reliability to the changes in temperature. To be more specific, in the conventional structure, connector housing 113 made of resin thermally expands and contracts repetitively due to the changes in temperature. Although eyelet terminal 114 is securely fixed to connector housing 113 at an initial stage, eyelet terminal 114 is loosen due to deterioration of the resin with time. Then, eyelet terminals 114 are resultantly taken off from connector housing 113, thus deteriorating the reliability to temperature change.

Frame 11 in accordance with this embodiment is detailed below. Connector housing 13 and frame 11 are made of the same resin, and molded simultaneously by injection molding. This method can reduce the number of components and the number of processes for manufacturing comparing with the case of molding connector housing 13 and frame 11 independently. This method thus improves the productivity of frame 11, thereby reducing cost of the loudspeaker.

Connector housing 13 and frame 11 can be made of different materials, and also they can be molded independently before they are coupled together.

An advantage in this case is that an optimal material can be selected to connector housing 13 and frame 11. For instance, frame 11 can employ a material excellent in heatproof and strength while connector housing 13 can employ a material excellent in moldability and heatproof. Such selections of materials provides the loudspeaker frame excellent in strength and heatproof, and improving the accuracy as well as the stability at receptacles of connector housing 13.

Next, connector 12 will be detailed below. Connector 12 in accordance with this embodiment includes connector housing 13 and two eyelet terminals 14, i.e., a pair of terminals, one is a positive terminal and the other is a negative terminal. Eyelet terminals 14 have shapes identical to each other, and have inserting directions reverse to each other by 180 degrees. In other words, the two terminals are symmetrical to each other. Each of left eyelet terminal 14 and right eyelet terminal 14 has first protrusion 14B detailed later, and a protruding direction of first protrusion 14B of left terminal 14 is reverse to that of right terminal 14. Second protrusions 14C described later also protrude in directions opposite to each other.

Connector housing 13 has guide wall 13H and bottom 13J. Guide wall 13H receives a counterpart connector (not shown) to be coupled with connector 12. Hole 13C is provided in bottom 13J, and second wall 13B is formed in hole 13C. Second wall 13B is parallel with bottom 13J, and is substantially perpendicular to the side wall surface of hole 13C.

According to the present embodiment, first wall 13A is formed by forming rectangular aperture 13D in the side wall surface of hole 13C. In other words, a side wall surface out of the four side wall surfaces of aperture 13D at a front of the connector constitutes second wall 13B. This structure forms second wall 13B at a midpoint of hole 13C.

First protrusion 14B is engaged with second wall 13B, thereby causing second wall 13B to regulate the position of eyelet terminal 14 in a direction opposite to the inserting direction of eyelet terminal 14.

Hole 13C has a bottom having a surface constituting first wall 13A. Slit 13E is formed in the bottom of hole 13C. First wall 13A constitutes a target which stopper 14A contacts. This structure allows first wall 13A to regulate the position of eyelet terminal 14 in the inserting direction of eyelet terminal 14.

Eyelet terminal 14 includes wide section 14E, narrow section 14D, and terminal section 14F. Narrow section 14D extends from wide section 14E along one direction while terminal section 14F extends from wide section 14E in another direction (opposite to narrow section 14D).

Wide section 14E includes stopper 14A corresponding to first wall 13A. According to this embodiment, a side wall surface of the periphery on the front side of wide section 14E works as stopper 14A. In this description, the front side of wide section 14E refers to as a top of the wide section in the inserting direction of eyelet terminal 14.

Eyelet terminal 14 further includes first protrusion 14B. According to this embodiment, protrusion 14B is formed on wide section 14E. First protrusion 14B is placed such that first protrusion 14B is engaged with second wall 13B while eyelet terminal 14 is inserted into hole 13C. According to this embodiment, eyelet terminal 14 is inserted into hole 13C from the front of connector housing 13, and narrow section 14D extends through slit 13E while eyelet terminal 14 is inserted into hole 13C. This structure allows narrow section 14D to protrude outside connector housing 13 at the rear of housing 13. Terminal section 14F protrudes inside housing 13 at the front of housing 13. Wide section 14E is accommodated in hole 13C.

Coupling section 14H is provided at a tip of narrow section 14D. Gold thread (not shown) or a winding of voice coil is connected to coupling section 14H by soldering.

Narrow section 14D has hole 14G therein which is provided between coupling section 14H and the root of narrow section 14D. This structure allows the heat of soldering to resist transmitting to connector housing 13, thereby preventing slit 13E from deforming due to the heat of soldering. Eyelet terminal 14 can be thus prevented from being taken off from connector housing 13. Eyelet terminal 14 can be also prevented from greater looseness along a Z-direction. The heat of soldering resists escaping, and the heat is focused to coupling section 14H, so that the soldering can be executed easily.

The above structure regulates the position for of eyelet terminal 14 in the inserting direction of eyelet terminal 14 while eyelet terminal 14 is inserted in hole 13C since stopper 14A contacts first wall 13A. On top of that, the above structure also regulates the position of eyelet terminal 14 in a direction opposite to the inserting direction of eyelet terminal 14 since first protrusion 14B is engaged with second wall 13B. The coupling between eyelet terminal 14 and connector housing 13 can be thus strengthened, and eyelet terminal 14 can be prevented from being taken off from connector housing 13.

Stopper 14A and first protrusion 14B position eyelet terminal 14 accurately with respective to connector housing 13.

Since second wall 13B is formed at an inside of hole 13C, eyelet terminal 14 can be regulated by the upper and lower side wall surfaces of hole 13C (the vertical direction in FIG. 3) on both sides of aperture 13D, so that positional accuracy of eyelet terminal 14 along the vertical direction can be improved. The foregoing structure locates second wall 13B away from a position to be soldered, so that second wall 13B can be prevented from deforming due to the heat of soldering. The smaller looseness on eyelet terminal 14 can be thus expected.

On top of that, upon being inserted into hole 13C, eyelet terminal 14 can be press-fitted in hole 13C due to first protrusion 14B. To be more specific, eyelet terminal 14 is temporarily press-fitted in hole 13C until first protrusion 14B is engaged with aperture 13D. However, this press-fitting can be done only while eyelet terminal 14 moves from the inlet of hole 13C to second wall 13B, so that the distance of press-fitting is very short. This structure prevents eyelet terminal 14 from deforming when terminal 14 is inserted into hole 13C.

On top of that, the position of eyelet terminal 14 can be regulated by stopper 14A and first wall 13A, so that even if the heat of soldering causes slit 13E to deform, eyelet terminal 14 can be prevented from being taken off from connector housing 13, and also greater looseness of eyelet terminal 14 along X-direction can be prevented.

According to this embodiment, first wall 13A is disposed behind second wall 13B, namely, first wall 13A is placed behind second wall 13B in the inserting side (in the arrow shown in the figure) of eyelet terminal 14. This structure allows wide section 14E to be longer, so that first protrusion 14B can be formed on wide section 14E. As a result, the smaller deformation of eyelet terminal 14 can be expected when terminal 14 is inserted into hole 13C.

Slit 13E of hole 13C and the periphery of slit 13E may deform due to the heat of soldering. To avoid this deforming, first wall 13A is placed behind second wall 13B. This structure allows the front of wide section 14E to regulate eyelet terminal 14 along the Z-direction. As a result, even if the upper or lower side wall surface of hole 13C around slit 13E or the periphery of slit 13E deform, this structure prevents the looseness on eyelet terminal 14 along the Z-direction from growing greater.

The positional accuracy of eyelet terminal 14 along Y-direction is regulated by a difference between a width in the Y-direction of wide section 14E and a width in the Y-direction of hole 13C. This structure prevents the positional accuracy along Y-direction of eyelet terminal 14 from becoming lower.

At an inlet port (an opposite wall to a hook for first protrusion 14B) of hole 13C for eyelet terminal 14, a cut surface 13F is formed. This structure allows cut surface 13F to guide eyelet terminal 14 at the insertion, so that eyelet terminal 14 can be inserted into hole 13C easily. As a result, the workability and the efficiency of the insertion of terminal 14 into hole 13C can be improved. The shape of cut surface 13F can be selected appropriately from a C-shaped surface cut or a round surface.

Eyelet terminal 14 in accordance with this embodiment further includes second protrusion 14C, which contacts the inlet port of hole 13C while terminal 14 is inserted in hole 13C. This structure further prevents eyelet terminal 14 from being loosened.

Second protrusion 14C protrudes in a direction opposite to a direction in which first protrusion 14B protrudes. This structure urges eyelet terminal 14 toward the lower surface of hole 13C, so that first protrusion 14B can be engaged with second wall 13B more firmly. Eyelet terminal 14 can be thus more rigidly coupled to connector housing 13, and eyelet terminal 14 can be prevented from being taken off from connector housing 13.

The entire structure allows individual structures to complement each other, thereby strengthening the coupling between eyelet terminal 14 and connector housing 13, and preventing eyelet terminal 14 from being taken off from connector housing 13. This structure also prevents the looseness between terminal 14 and housing 13 as well as abnormal sound caused by the looseness.

On top of that, sawtooth provided conventionally is not needed, which prolongs a service life of the tooling die for manufacturing eyelet terminal 14. In other words, a maintenance cost of the tooling die for eyelet terminal 14 can be reduced.

Since connector housing 13 is molded with frame 11 and molded with the same resin, connector 12 can be prevented from being taken off from frame 11, and the looseness between frame 11 and connector 12 as well as the abnormal sound caused by the looseness can be prevented. This structure reduces the number of components of connector 12 as well as the number of processes for manufacturing connector 12. As a result, the productivity and the cost reduction of connector 12 can be expected.

As discussed above, the loudspeaker frame according to the present invention provides advantages of high quality and high reliability.

Figure 5:
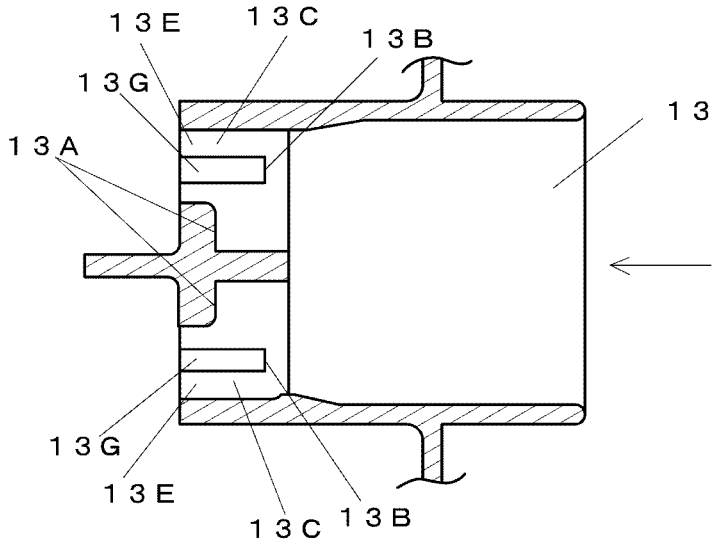
FIG. 5 is a sectional view of an essential part of a second example of the connector housing of the loudspeaker frame in accordance with Embodiment 1.

FIG. 5 is an enlarged view of an essential part of a second example of the connector housing. As shown in FIG. 5, second wall 13B can be constituted by cutout 13G. Cutout 13G is connects with a rear of connector housing 13. In this case, a width of cutout 13G in the Y-direction is smaller than that of slit 13E. This structure prevents the looseness of eyelet terminal 14 along the Z-direction from growing greater, and also prevents the positional accuracy along Z-direction of terminal 14 from lowering.

Figure 6:
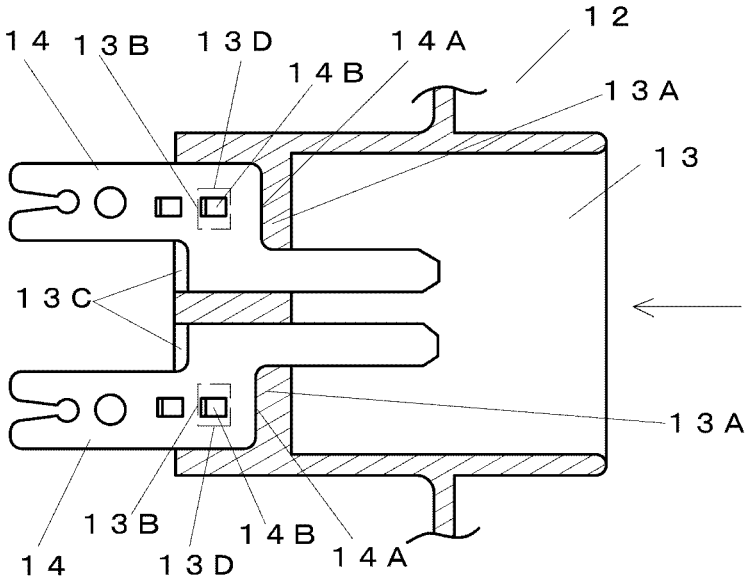
FIG. 6 is a sectional view of an essential part of the second example of the connector section of the loudspeaker frame in accordance with Embodiment 1.

FIG. 6 is an enlarged sectional view of the second example of an essential part of the connector in accordance with the embodiment. As shown in FIG. 6, eyelet terminal 14 can be inserted from the rear of connector housing 13 into hole 13C.

Exemplary Embodiment 2

Figure 7:
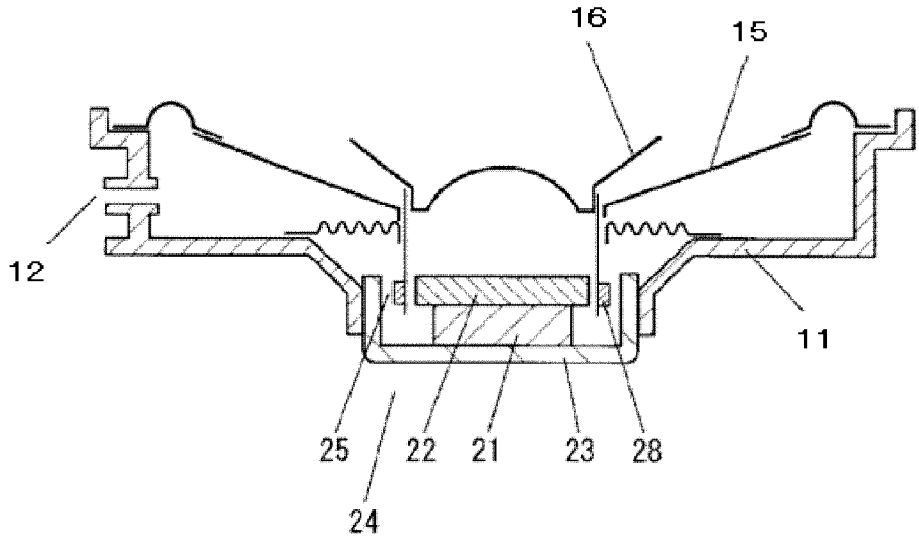
FIG. 7 is a sectional view of a loudspeaker in accordance with Exemplary Embodiment 2 of the invention.

Exemplary Embodiment 2 will be demonstrated hereinafter. FIG. 7 is a sectional view of a loudspeaker in accordance with Embodiment 2 of the present invention. Magnetic circuit 24 used in the loudspeaker in accordance with Embodiment 2 is an inner magnet type magnetic circuit.

To be more specific, magnet 21 is sandwiched between upper plate 22 and yoke 23. Loudspeaker frame 11 in accordance with Embodiment 1 is coupled to yoke 23 of magnetic circuit 24.

The periphery of loudspeaker frame 11 is connected with an outer circumference of diaphragm 15. A first end of voice coil 28 is coupled to a center of diaphragm 15. A second end of voice coil 28 opposite to the first end is positioned in magnetic gap 25 of magnetic circuit 24. Sub-cone 16 is bonded to a front of voice coil 28.

Connector 12 is coupled with loudspeaker frame 11 as discussed in Embodiment 1. Eyelet terminal 14 is inserted into connector housing 13 to cause narrow section 14D to protrude from connector housing 13. The lead-wire or gold-thread extending from voice coil 28 is coupled to narrow section 14D by soldering.

According to Embodiment 2, the loudspeaker includes inner-magnet type magnetic circuit 24; however, the loudspeaker is not limited to this type, and this embodiment is applicable to a loudspeaker including an outer-magnet type magnetic circuit.

The above structure provides a loudspeaker with eyelet terminal 14 that is prevented from being taken off from connector housing 13. On top of that, the foregoing structure reduces the looseness between eyelet terminal 14 and connector housing 13, so that the loudspeaker free from abnormal sound caused by the looseness is obtainable.

Since connector housing 13 is molded with loudspeaker frame 11, connector 12 is not taken off from frame 11. This structure avoids generating abnormal sound caused by the looseness between frame 11 and connector 12. This structure reduces the number of components of connector housing 13, so that the number of processes for manufacturing connector 12 can be reduced. The productivity of the loudspeaker can be improved, and the cost reduction thereof can be expected. Connector housing 13 and frame 11 can be injection-molded simultaneously with the same resin material, so that the number of processes for manufacturing connector 12 can be reduced.

According to Embodiment 2, the loudspeaker has high quality and reliability.

Exemplary Embodiment 3

Figure 8:
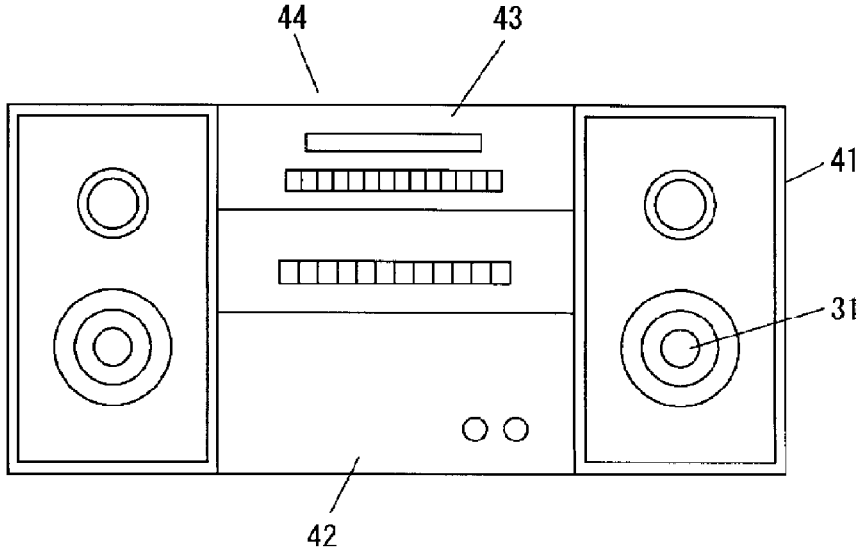
FIG. 8 is an external view of an electronic device in accordance with Exemplary Embodiment 3 of the invention.

FIG. 8 is a schematic view of an electronic device in accordance with Exemplary Embodiment 3 of the present invention. According to Embodiment 3, audio mini-component system 44 is used as the typical electronic device. As shown in FIG. 8, a loudspeaker system is formed by incorporating loudspeakers 31 of the present invention into enclosure 41. This loudspeaker system includes amplifier 42 for amplifying an electric signal to be input to loudspeakers 31 and player 43 for supplying a source signal to be input into amplifier 42.

The above structure provides the electronic device that avoids the looseness between eyelet terminal 14 and connector housing 13 of loudspeaker 31, and the electronic device is resultantly free from abnormal sound caused by the looseness.

On top of that, since connector housing 13 is molded and simultaneously with frame 11 by injection molding the same resin, so that connector 12 is prevented from being taken off from frame 11 and the looseness also resists being generated. As a result, the electronic device free from abnormal sound caused by the looseness is obtainable.

According to Embodiment 3, the electric device has great advantages, such as improving the productivity, cost reduction, high quality, and reliability.

Exemplary Embodiment 4

Figure 9:
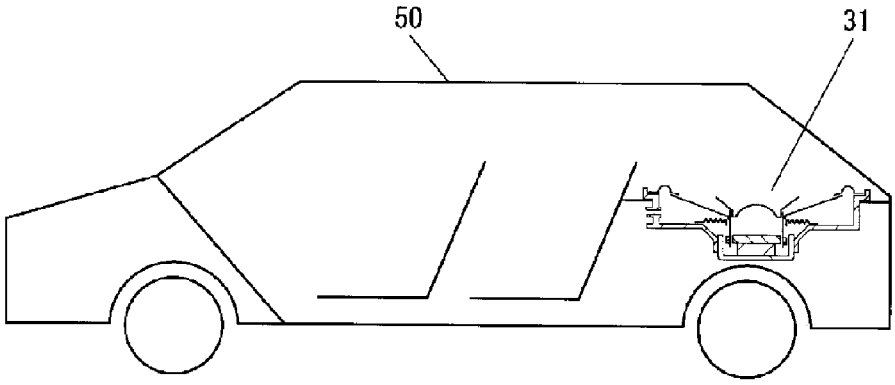
FIG. 9 is a schematic view of a mobile device according to the invention.

FIG. 9 is a sectional view of a mobile device in accordance with Exemplary Embodiment 4 of the present invention. According to Embodiment 4, car 50 is used as the typical mobile device. Car 50 is equipped with, e.g. a car-navigation system and car-audio system. Loudspeaker 31 functions as a part of the car-navigation system and the car-audio system. Loudspeaker 31 of the present invention is installed into a rear tray or a front panel of car 50. However, the position of loudspeaker 31 is not limited to the rear tray or the front panel, for instance, loudspeaker 31 can be mounted to any place, such as door, ceiling, pillar, in- or under-dashboard, or floor.

The above structure prevents the looseness, caused by vibrations during the drive, between eyelet terminal 14 and connector housing 13. The mobile device free from abnormal sound caused by the looseness is thus obtainable. On top of that, connector housing 13 is molded with loudspeaker frame 11, so that connector 12 can be prevented from being taken off from frame 11 caused by the vibrations during the drive of car 50, and the looseness between frame 11 and connector 12 can be avoided. As a result, the mobile device free from abnormal sound caused by the looseness is obtainable. According to Embodiment 4, the mobile device has great advantages, such as high productivity, the cost reduction thereof, high quality, and high reliability.

INDUSTRIAL APPLICABILITY

A loudspeaker frame according to the present invention is applicable to a loudspeaker frame that needs achieving high-quality and high reliability.

REFERENCE MARKS IN THE DRAWINGS

11 Frame
12 Connector
13 Connector Housing
13A First Wall
13B Second Wall
13C Hole
13D Aperture
13E Slit
13F Cut Surface
13G Cutout
13H Guide Wall
13J Bottom
14 Eyelet Terminal
14A Stopper
14B First Protrusion
14C Second Protrusion
14D Narrow Section
14E Wide Section
14F Terminal Section
14G Hole
14H Coupling Section
15 Diaphragm
16 Sub-Cone
21 Magnet
22 Upper Plate
23 Yoke
24 Magnetic Circuit
25 Magnetic Gap
28 Voice Coil
31 Loudspeaker
41 Enclosure
42 Amplifier
43 Player
44 Mini-Component System
50 Car
111 Frame
112 Connector
113 Connector Housing
114 Eyelet Terminal

The invention claimed is:

1. A loudspeaker frame comprising:

a frame section made of resin;

a connector housing made of resin molded with the frame section;

a hole provided in a bottom of the connector housing; and an eyelet terminal extending through the hole and having a flat plate shape, wherein a first wall for regulating a position of the eyelet terminal in an inserting direction of the eyelet terminal and a second wall for regulating the position of the eyelet terminal in a direction opposite to the inserting direction of the eyelet terminal are provided on the bottom of the connector housing, wherein the eyelet terminal includes:

a stopper disposed at a place corresponding to the first wall and contacting the first wall as to regulate the position of the eyelet terminal in the inserting direction of the eyelet terminal; and a first protrusion engaged with the second wall, wherein the second wall is provided at a side wall surface of the hole, wherein the second wall is constituted by an aperture provided in the connector housing or a cutout provided in the connector housing, wherein the first wall is provided in the hole, wherein the eyelet terminal includes a wide section, wherein the stopper is constituted by a top surface of the wide section in the inserting direction of the eyelet terminal, and wherein the first wall is positioned behind the second wall along the inserting direction of the eyelet terminal.

2. The loudspeaker frame according to claim 1, wherein the eyelet terminal further includes:

a narrow section extending in one direction from the wide section and protruding outside the connector housing at a rear face of the connector housing, the narrow section having a width smaller than a width of the wide section; and a terminal section extending in another direction from the wide section and protruding inside the connector housing at a front face of the connector housing.

3. The loudspeaker frame according to claim 1, wherein a cut surface is formed on the connector housing so as to insert the eyelet terminal easily.

4. The loudspeaker frame according to claim 1, wherein the eyelet terminal includes a second protrusion for applying a pressure to a part of the connector housing in order to prevent looseness.

5. The loudspeaker frame according to claim 2, wherein a coupling section is provided at an end of the narrow section, a hole is provided between the coupling section and a root of the narrow section.

6. A loudspeaker comprising:

the loudspeaker frame according to claim 1;

a magnetic circuit provided to the loudspeaker frame;

a voice coil located in a magnetic gap of the magnetic circuit; and a diaphragm fixed to the loudspeaker frame and the voice coil.

7. An electronic device comprising the loudspeaker according to claim 6.

8. A mobile device comprising the loudspeaker according to claim 6.

9. The loudspeaker frame according to claim 2, wherein, in a direction perpendicular to the inserting direction of the eyelet terminal, the narrow section of the eyelet terminal further has the width smaller than the width of the wide section.

10. A loudspeaker frame comprising:

a frame section made of resin;

a connector housing made of resin molded with the frame section;

a hole provided in a bottom of the connector housing; and an eyelet terminal extending through the hole and having a flat plate shape, wherein a first wall for regulating a position of the eyelet terminal in an inserting direction of the eyelet terminal and a second wall for regulating the position of the eyelet terminal in a direction opposite to the inserting direction of the eyelet terminal are provided on the bottom of the connector housing, wherein the eyelet terminal includes:

a stopper disposed at a place corresponding to the first wall and contacting the first wall as to regulate the position of the eyelet terminal in the inserting direction of the eyelet terminal;

a first protrusion engaged with the second wall, and wherein the second wall is provided at a side wall surface of the hole, wherein the second wall is constituted by an aperture provided in the connector housing or a cutout provided in the connector housing, wherein the first wall is provided in the hole, wherein the eyelet terminal includes:

a wide section;

a narrow section extending in one direction from the wide section and protruding outside the connector housing at a rear face of the connector housing, the narrow section having a width smaller than a width of the wide section; and a terminal section extending in another direction from the wide section and protruding inside the connector housing at a front face of the connector housing, wherein the stopper is constituted by a top surface of the wide section in the inserting direction of the eyelet terminal, and wherein a coupling section is provided at an end of the narrow section, a hole is provided between the coupling section and a root of the narrow section.

11. The loudspeaker frame according to claim 10, wherein, in a direction perpendicular to the inserting direction of the eyelet terminal, the narrow section of the eyelet terminal further has the width smaller than the width of the wide section.

* * * * *